US008092360B2

(12) United States Patent
Greenfield

(10) Patent No.: US 8,092,360 B2
(45) Date of Patent: Jan. 10, 2012

(54) METHODS FOR CREATING MULTI-WALLED CONTAINERS

(75) Inventor: Giles Greenfield, Tacoma, WA (US)

(73) Assignee: Greenfield Bin, LLC, Renton, WA (US)

( * ) Notice: Subject to any disclaimer, the term of this patent is extended or adjusted under 35 U.S.C. 154(b) by 99 days.

(21) Appl. No.: 12/380,601

(22) Filed: Feb. 27, 2009

(65) Prior Publication Data

US 2009/0233777 A1 Sep. 17, 2009

Related U.S. Application Data

(63) Continuation of application No. PCT/US2007/019202, filed on Aug. 31, 2007, and a continuation-in-part of application No. 11/514,430, filed on Aug. 31, 2006.

(51) Int. Cl.
*B31B 1/26* (2006.01)

(52) U.S. Cl. ..... 493/162; 493/89; 493/93

(58) Field of Classification Search ..... 493/89, 493/93, 162; 229/185.1, 939, 182, 165, 122.32, 229/122.33, 137, 920; 220/62.11
See application file for complete search history.

(56) References Cited

U.S. PATENT DOCUMENTS

| | | | | |
|---|---|---|---|---|
| 930,114 | A * | 8/1909 | Adams | 229/117.01 |
| 1,234,917 | A | 7/1917 | McClay | |
| 1,811,135 | A | 6/1931 | Knowlton | |
| 1,943,074 | A * | 1/1934 | Heyman | 229/125.38 |
| 2,348,070 | A * | 5/1944 | Inman | 229/142 |
| 2,367,476 | A | 1/1945 | Tyrseck | |
| 2,758,780 | A | 8/1956 | Imbs | |
| 2,965,280 | A * | 12/1960 | Miller | 229/110 |
| 3,019,957 | A | 2/1962 | Palmer | |
| 3,027,060 | A | 3/1962 | Beder | |
| 3,137,437 | A | 6/1964 | Svensson | |
| 3,193,172 | A * | 7/1965 | Welshenbach | 229/122.32 |
| 3,248,039 | A | 4/1966 | Locke | |
| 3,313,466 | A * | 4/1967 | Keith | 229/120.15 |
| 3,366,496 | A | 1/1968 | Bomar | |
| 3,643,856 | A | 2/1972 | Jones | |

(Continued)

FOREIGN PATENT DOCUMENTS

DE 202 15 333 U1 1/2003

(Continued)

OTHER PUBLICATIONS

PCT International Search Report from International Application No. PCT/US07/19202 dated Apr. 3, 2008.

*Primary Examiner* — Hemant M Desai
(74) *Attorney, Agent, or Firm* — Sound Intellectual Property PLLC

(57) ABSTRACT

Methods for making multi-walled containers from a single blank, preferably using a continuous process approach, and the resulting containers are disclosed. Various embodiments of the invention include, alone or in combination, intermediate panels formed from flap precursors that are in- or out-folded such that their distal ends are in proximate relationship to each other; outer flaps sized to overlap exposed edges of a container formed from the blank; stress relief features a joint corners to reduce stresses thereat. Methods for making select containers of the invention include folding and adhering the flap precursors to an inner panel, up-folding the inner panel/intermediate panel combination about a mandrel, and continuing to up-fold the outer panel until a container having a "use" position as a resting position is formed.

19 Claims, 12 Drawing Sheets

U.S. PATENT DOCUMENTS

| | | | | | |
|---|---|---|---|---|---|
| 3,829,000 | A | | 8/1974 | Ellison | |
| 3,918,631 | A | * | 11/1975 | Hackenberg | 229/208 |
| 4,083,454 | A | | 4/1978 | O'Neill | |
| 4,087,041 | A | | 5/1978 | Centanni | |
| 4,133,474 | A | | 1/1979 | Hall | |
| 4,177,893 | A | | 12/1979 | Kornfeld | |
| 4,177,935 | A | | 12/1979 | Centanni | |
| 4,177,936 | A | | 12/1979 | Ford, Jr. | |
| 4,260,442 | A | | 4/1981 | Ford | |
| 4,441,948 | A | | 4/1984 | Gillard | |
| 4,586,627 | A | | 5/1986 | Grigsby | |
| 4,623,072 | A | | 11/1986 | Lorenz | |
| 5,000,377 | A | * | 3/1991 | McClure | 229/154 |
| 5,363,981 | A | | 11/1994 | Giblin et al. | |
| 5,649,663 | A | | 7/1997 | Pestow, Jr. | |
| 5,944,252 | A | | 8/1999 | Connelly | |
| 6,015,084 | A | | 1/2000 | Mathieu | |
| 6,045,038 | A | | 4/2000 | Smith et al. | |
| 6,138,903 | A | | 10/2000 | Baker | |

FOREIGN PATENT DOCUMENTS

| | | |
|---|---|---|
| FR | 1 289 322 | 3/1962 |

* cited by examiner

METHODS FOR CREATING MULTI-WALLED CONTAINERS

BACKGROUND OF THE INVENTION

Large format containers, generally referred to as "bins", are used to hold a variety of materials, usually for transport but also for retail display. Because more than 95% of all products in the US are shipped in corrugated boxes, and because of the cost advantages associated with this form of packaging, most bins are constructed from corrugated paperboard. But while about 90% of all corrugated paperboard is single wall, the relatively large dimensions of bins in conjunction with the nature of the goods being placed in the bins require the additional strength provided by multiple wall construction.

The prior art is replete with various methods for establishing a desired level of sidewall burst strength, bottom crush resistance and vertical load capacity for bins. Some solutions employ the use of double or triple wall corrugated paperboard as the starting material, while others rely upon layering walls or nesting boxes. Each of these approaches, however, includes advantages as well as disadvantages. Exemplary disadvantages include high manufacturing costs due to material handling requirements during manufacture, significant use of adhesives or fabrication equipment, pre- and post manufacture handling difficulties (prior to box converting such as when handling large area blanks or after converting such as when attempting to prepare the manufactured bins for shipping), and generation of waste material, all of which are well known to the skilled practitioner.

In view of these disadvantages, an improved bin and related manufacturing process would use easy-to-create/source single wall corrugated material, would use minimal amounts of adhesive during the converting process, would require minimal human effort before, during and after the converting process, would generate minimal waste, and would require minimal handling, among other requirements. While such needs exist, heretofore, such needs have not been met.

SUMMARY OF THE INVENTION

Methods according to the invention are directed to creating multi-walled containers from a corrugated material with minimal intentional waste, wherein the containers are formed from a single sheet or preferably a continuous web of corrugated material, such as single wall corrugated board, or double wall corrugated board (whether single or dual arch). Methods according to the invention cause the sheet or web of corrugated material to engage a wrapping mandrel, which creates the physical form of the container during the folding and attaching (e.g., gluing) process. Methods according to the invention also involute flap precursors to establish a container wall, thereby dispensing with the common method of gluing an "inner box" to the container.

Articles produced by method embodiments of the invention are characterized as having at least one container wall comprised from a pair of opposing flap precursors that are attached or otherwise permanently associated with a conventional sidewall of the container. In addition, articles produced by method embodiments of the invention include, alone or in combination, unstressed vertical folds at corner edges, interlocking/intermeshing flap precursors, corner stress relief features and others that will become apparent from this specification.

Because methods according to the invention create a multi-walled container from a single sheet or web of material (as opposed to using inserts or a box-within-a-box design), it is possible, as well as desirable, to create the container in a single operation, which advantageously lends itself to a continuous process. Moreover, a continuous process will usually dispense with the need to manage, i.e., handle, container blanks. Additionally; multi-walled containers are usually large, e.g., from approximately 40" or about 1 meter in width/side. At this scale, conventional large, multi-walled container blanks would be very large, approaching 15 feet or about 4.5 meters in length, but according to the invention, blanks for the various embodiments might approach 30 feet or about 9 meters in length. If container embodiments of the invention were formed using traditional construction methodologies, e.g., one apparatus manufactures the blanks, the blanks are then moved to storage, and then moved to a converting or box making machine, storage, transport and handling of such large format blanks would present a formidable challenge (batch transportation of 30 foot blanks is not easy). By using a continuous process wherein a web or constant source of material is fed into a converting or box making machine, all material batch handling requirements that would otherwise be associated with conventional blank-based box making procedures can be eliminated.

While the foregoing description of method embodiments of the invention emphasizes the benefits of using a continuous process approach to making containers according to the invention, the invention is not limited to such approaches. Moreover, even in a continuous process, blanks will be formed prior to the conversion of the material into a discrete container. Thus, the term "blank" as used herein includes both conventional container blanks not derived from a continuous process as well as those that are so derived. In the event that a distinction is to be made, and it is otherwise not clear from the context of usage, the term "conventional blanks" or similar wording will refer to blanks not derived from a continuous process.

Methods of making containers according to the invention utilize in- or out-folded flap precursors to establish a container wall, in particular between an outer wall and an inner wall of a manufactured container. In certain preferred article of manufacture embodiments of the invention, flap precursors of a blank used to create the container are dimensioned to either individually, or in combination, create a sidewall. Thus, in one series of container embodiments, opposing flap precursor are folded toward each other, and attached, such as by adhesive, to the panel from which they extended. Once folded and adhered, these flap precursors collectively form an additional sidewall of the container. By employing this method for producing the general equivalent of triple wall containers where the flap precursors constitute middle flaps, it is possible to construct such a container with virtually no planned waste. The intermediate panels may be contiguous, discontinuous in the longitudinal blank direction, or a combination thereof.

Methods according to the invention in yet another respect comprise creating a multi-walled container that has a generally unstressed vertical fold at all corner edges. By forming the container about a mandrel having the desired shape of the container (at least side walls thereof), the resultant container's relaxed state is that of its in-use form. As a result, each vertical corner of a four-sided container is less susceptible to tearing and breakage during use, as is common in the prior art. The same applies to both 6 and 8 corner styles. Thus, handling and storage of the resulting containers is enhanced since no vertical corner in the four sided configuration, for example, undergoes substantially greater than a 900 bend from its "use"

geometry to its "knocked down" geometry. Moreover, when such a corner edge is under induced stress, it is not usually subject to dynamic loads; it is in a folded and likely stored state. In contrast, when the container is most likely subject to dynamic loads such as during use and transportation of goods, these corner edges are in their nominal, generally unstressed geometry. This configuration also facilitates restoration of the container shape from the "knocked down" geometry, which for large format containers can be quite a meaningful advantage over the prior art.

In still other methods according to the invention, a corner stress relief feature is created at the intersection of a flap joint and a panel joint, preferably on the outermost panels and flaps, by selective material removal. Because this intersection would otherwise undergo bidirectional manipulation (panel folding and flap folding), select removal of material from this intersection permits a greater degree of articulation and delocalizes stresses that would otherwise occur at a highly specific location. In one series of embodiments, a roughly circular piece of material is removed at and/or near the fold intersections. The resulting blank and/or container precursor would then incorporate this feature as a structural element thereof.

Certain methods according to the invention also establish that a slit for separating two flaps or flap portions be offset from a score to facilitate bending of two adjacent panels. The offset, which preferably occurs with respect to the outer panels and flaps, is preferably approximately equal to the thickness dimension of the material (web or blank) used to construct the container, such as when a three wall container is created. When implemented, each flap will have a width dimension that is different (longer or shorter) than the width dimension of the panel width from which it extends. When the container is assembled into its final configuration, the wider outer flaps will extend to the outer edge of the container, and the inner flaps will fully extend over the intermediate and inner layer, thereby providing additional stacking strength and making full use of, and contact with, the outer panel(s) of the container. Those persons skilled in the art will appreciate that this configuration is more easily achieved when used in conjunction with the previously described stress relief feature.

Within the context of the invention, articles resulting from the practice of the various method embodiments comprise a single blank for forming a multiple sidewall container, container precursor, as well as the resulting container. The blank defines a longitudinal direction from a first end to a second end, and comprises an inner panel forming inner sidewalls of the container when assembled, wherein the inner panel has a plurality of inner panel portions, each inner panel portion being contiguous with any adjacent inner panel portion and each inner panel portion making up one inner sidewall of the container when assembled.

The blank further comprises at least one pair of flap precursors, which may comprise opposing middle flaps extending from the inner panel to a distal edge, wherein the sum of the average lateral lengths of the pair of flap precursors from their intersection with a panel to a distal edge is equal to or less than the lateral length of the panel from the intersection of a first opposing flap precursor to the intersection of a second opposing flap precursor. Furthermore, each flap precursor or middle flap preferably has a plurality of flap portions, each flap portion being contiguous, or discrete but adjacent, with any adjacent flap portion and each opposing pair of flap portions making up one sidewall of the container when assembled.

In addition, the blank comprises, in three layer sidewall embodiments, an outer panel extending longitudinally from the inner panel forming outer sidewalls of the container when assembled, wherein the outer panel preferably has a plurality of outer panel portions, each outer panel portion being contiguous with any adjacent outer panel portion and each outer panel portion making up an outer sidewall of the container when assembled. If additional intermediate sidewalls are desired, then the outer panel will preferably extend from a last intermediate panel. In the described three sidewall embodiment, such (an) intermediate panel(s) is/are located longitudinally between the inner panel and the outer panel.

As noted above, container embodiments of methods according to the invention comprise containers wherein the combined average lateral widths of the flap precursors are equal to or less than the lateral width of the panel from which they extend. This relationship permits the at least one pair of opposing flaps to be involuted during container fabrication, thereby bringing their respective distal edges into proximity with each other and with the associated panel from which they extend. In a three layer embodiment, the flap precursors may constitute either the inner or intermediate panel, and the panel from which they extend may constitute the other panel. The resulting involuted structure can then function as sidewalls when the container precursor is assembled into the container. The skilled practitioner will of course realize that as the geometries of the distal edges vary, so may the lateral length determinations. Thus, while the combined lengths are described in terms of "average", it is within the scope of the invention to include any geometry that will not result in an overlapping condition when the opposing flaps are involuted and brought into relative proximity with one another.

In certain container embodiments of the invention, an interlocking or inter-meshing pair of opposing flap precursor edges are formed, such as by die cutting. In these embodiments, stresses at what would otherwise be localized at a butt joint after involution and formation of the container are dispersed over a longer edge and larger area of adjacent sidewall of the container when in use. This is especially important when maximizing burst and vertical compression strength values.

Industrial implementations of the invention (systems) comprise a plurality of stations wherein various treatments are applied to a blank or continuous web of material in order to create a container. For purposes of the instant disclosure, methods of forming a container according to the invention will begin with an appropriately sized "blank" as that term has been previously defined. Selection of the features to be incorporated into the container will determine the presence and order of methods and apparatus used to form the intended container. For the purpose of illustration only, a basic construction of a triple wall, four sided container will initially be described below. Once the blank is converted, flap precursors are adhered to associated panels as previously described and the container precursor is subject to involution. During the involution of the container precursor, panels forming adjacent layers are brought into compressive contact, and adhered to one another to form the container, which is subsequently removed and optionally "knocked down".

BRIEF DESCRIPTION OF THE DRAWINGS

FIG. 13 is a plan view of a system for receiving converted blanks and creating assembled containers there from;

DESCRIPTION OF THE INVENTION EMBODIMENTS

The following discussion is presented to enable a person skilled in the art to make and use the invention. Various modifications to the embodiments shown herein will be readily apparent to those skilled in the art, and the generic principles herein may be applied to other embodiments and applications without departing from the spirit and scope of the present invention, as defined by the appended claims. Thus, the present invention is not intended to be limited to the embodiments shown, but is to be accorded the widest scope consistent with the principles and features disclosed herein.

Turning then to the several Figures, where like numerals indicate like parts, and more particularly to FIGS. 1-4, an embodiment of the invention employing many of the features and elements of the invention will now be described. Container 20 comprises "blank" 22, which is preferably constructed from a double lined, single wall corrugated material such as 5/16" L flute corrugated board shown in FIG. 2. In the illustrated embodiment, container 20 has dimensions of about 42"H×48"W×40"D, while blank 22 has maximum dimensions of about 355"L×83"W. In the illustrated embodiment, container 20 has triple sidewalls and single overlapping bottom and top flaps.

Figure 4:
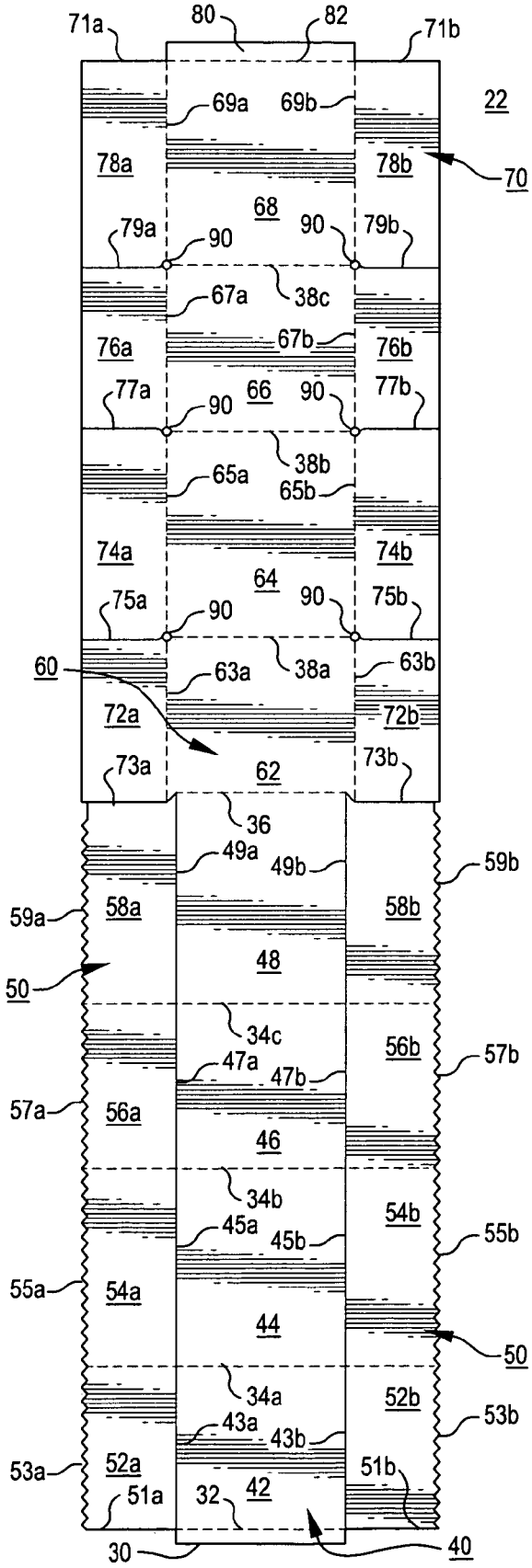
FIG. 4 is a plan view of a "blank" used to form the first embodiment of the invention.

In order to form container 20, it is necessary to create container blank 22 either prior to assembly or in line with the assembly process. As is best shown in FIG. 4, container blank 22 is a unitary piece of corrugated material, such as of the type shown in FIG. 2, with the direction of corrugation running laterally. From a single sheet, selected scores, cuts and perforations are carried out, such as by rotary die cutter(s) or other means appreciated by the skilled practitioner. Each container blank 22 then comprises inner panel 40, opposing middle flaps 50, outer panel 60, and a plurality of end flaps 70. Container blank 22 preferably further comprises inner tab 30 and optional outer glue tab 80. For convention purposes, the observed sides of all panels and flaps are as indicated, with the reverse side being numbered similarly, but within the one hundred series. Thus, the reverse side of inner panel 40, for example, is labeled as inner panel 140.

Inner panel 40 comprises inner panel portions 42, 44, 46 and 48, separated by scores 34*a*, 34*b*, and 34*c*. Inner tab 30 extends longitudinally from inner panel portion 42, and is separated there from by score 32. Extending laterally outwardly from inner panel portions 42, 44, 46 and 48, and defined in part by slit-scores 43*a/b*, 45*a/b*, 47*a/b* and 49*a/b*, and by scores 34*a*, 34*b*, and 34*c* (as well as edges 51*a/b*, and slits 73*a* and 73*b*), are respective middle flaps 50, identified in this embodiment as middle flap portions 52*a/b*, 54*a/b*, 56*a/b* and 58*a/b*. While those persons skilled in the art will appreciate that other forms of scoring (e.g., point-to-flat) as well as slitting or even slotting can be used instead of those portions of scores 34*a*, 34*b*, and 34*c* that partially define each middle flap portion pair 52*a/b*, 54*a/b*, 56*a/b* and 58*a/b*, additional strength and handling advantages can be realized by retaining robust physical linkage between adjacent middle flap portions, as will be described below. Moreover, each "flap" 50 may comprise physically discrete flap portions (as are end flaps 70, discussed below), visually discrete flap portions as illustrated herein, or may be wholly contiguous (no scoring). Because it is only necessary to form a wall or layer within container 20, there is no intrinsic need to form physically discrete flap portions as long as those portions of blank 22 that fold to meet the opposing portions of blank 22 can result in the creation of such wall or layer.

The distal ends of each middle flap portion are characterized by chevron edges 53*a/b*, 55*a/b*, 57*a/b* and 59*a/b*, again as shown best in FIG. 4. The inclusion of these chevron edges, or any non-linear edge, will beneficially delocalize burst and column compression stresses that may occur after assembly and use of container 20, as will be described in later detail below. Thus, curvilinear edges or rectilinear edges such as repeating square or saw-tooth geometries are considered desirable. However, it is not necessary to the operation or constitution of the embodiments of the invention to incorporate such non-linear edges, and a linear edge will provide benefits as herein described.

Figure 11:
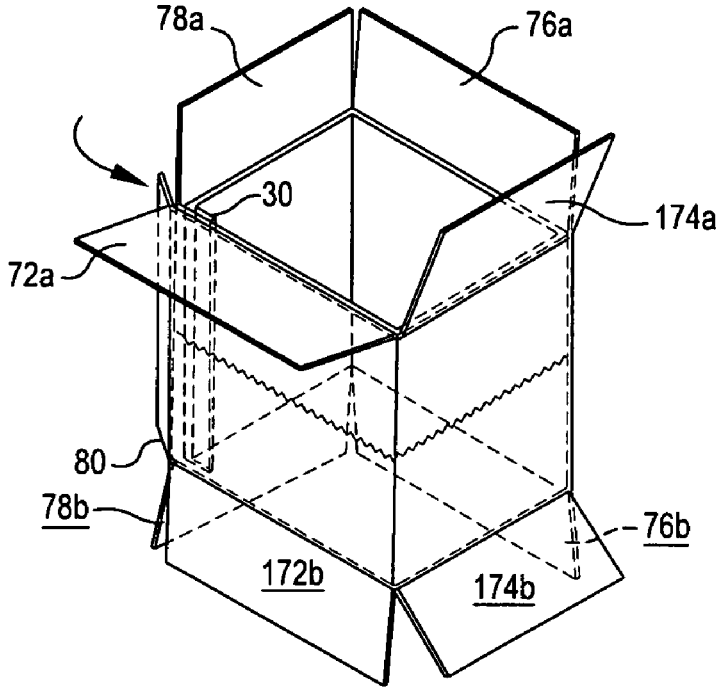
FIG. 11 is a perspective view of a sixth step in forming a multi-walled container using the "blank" of FIG. 4 where an outer glue tab is attached to an outer panel, completing formation of the first embodiment.
Figure 12:
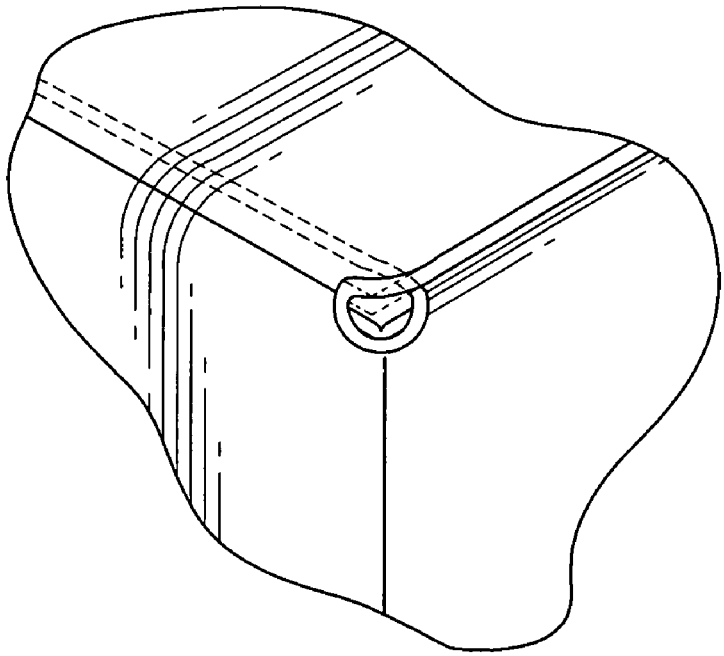
FIG. 12 is a detailed perspective view of a stress relief feature shown in FIG. 5 when the "blank" of FIG. 4 is converted into the container of FIG. 11, and the upper and lower flaps are folded inward.

While inner panel 40 and middle flaps 50 both form sidewalls of the container, only outer panel 60 forms sidewalls; end flaps 70 constitute single bottom and top sides of container 20 as shown in FIG. 11. Outer panel 60 comprises outer panel portions 62, 64, 66 and 68, separated by scores 38*a*, 38*b*, and 38*c*; outer panel portion 62 is separated from inner panel portion 48 by score 36. Outer glue tab 80 extends longitudinally from inner panel portion 42, and is separated there from by score 82. Extending laterally outwardly from outer panel portions 62, 64, 66 and 68, and defined in part by point-to-point scores 63*a/b*, 65*a/b*, 67*a/b* and 69*a/b*, and by slits 73*a/b*, 75*a/b*, 77*a/b* and 79*a/b* (as well as edges 71*a/b*), are respective end flaps 72*a/b*, 74*a/b*, 76*a/b* and 78*a/b*, as shown. Those persons skilled in the art will appreciate that slots can be used instead of slits 73*a/b*, 75*a/b*, 77*a/b* and 79*a/b*, although as will be described in detail below, advantages can be achieved through the use of slits with respect to stress relief feature 90.

It should be noted that the lateral width (or as assembled, the height) of outer panel 60 is greater than that of inner panel 40. This increased dimension addresses the consequence of the increased external dimensions as container 20 is formed (discussed and shown below). Similarly, the longitudinal length (or as assembled, the width and depth) of outer panel 60 is greater than that of inner panel 40. Those persons skilled in the art will appreciate that the increases are related to the number of walls used to form the container, as well as the thickness of the material comprising the walls.

Figure 5:
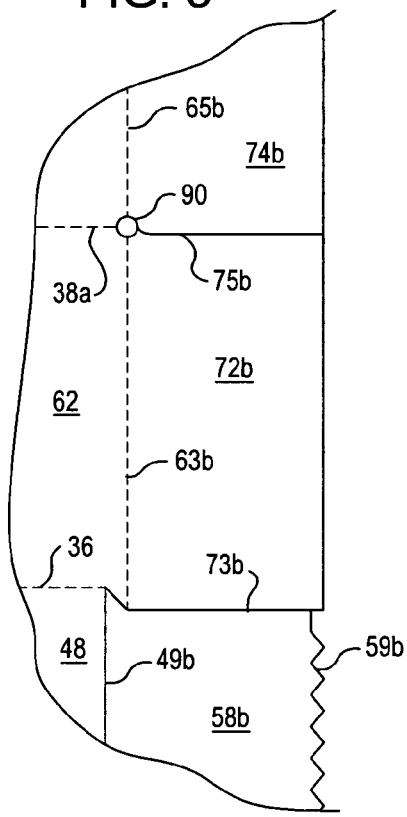
FIG. 5 is a detailed plan view of a stress relief feature and vertical crush resistance geometry feature of the first embodiment of the invention.

FIG. 5 illustrates two features of the subject embodiment, namely, stress relief feature 90, which is characterized as a hole of approximately 0.375" diameter, and flap offsets. It is well known in the art that flaps on containers frequently tear at the exposed edge interface between the flap and a sidewall panel. This is due in part to the effect of the three edge corner present on the underside of the flap: the three edge corner causes a crushing of the flap at its edge, thereby compromising the structural integrity of the flap and related structure. This consequence, in conjunction with the inherent weakness of the material at this position, often invites mechanical failure during repeated use or operation of the flap. By establishing a hole, and preferably, but not necessarily, a round or circular hole, the three edge corner will not directly impinge upon the underside of the flap. Depending upon the number of walls for any particular container, additional stress relief features may be employed with respect to interior or middle walls, as the case may be.

Figure 3:
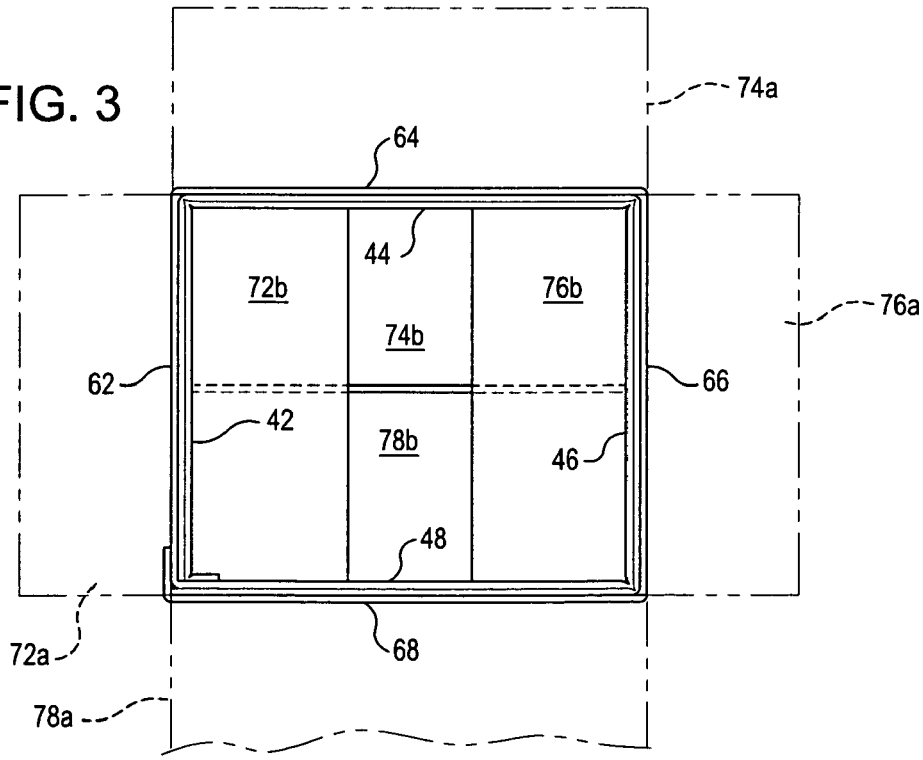
FIG. 3 is a plan view of the first embodiment with the upper flaps shown in phantom to better illustrate the layering of the corrugated material.
Figure 3A:
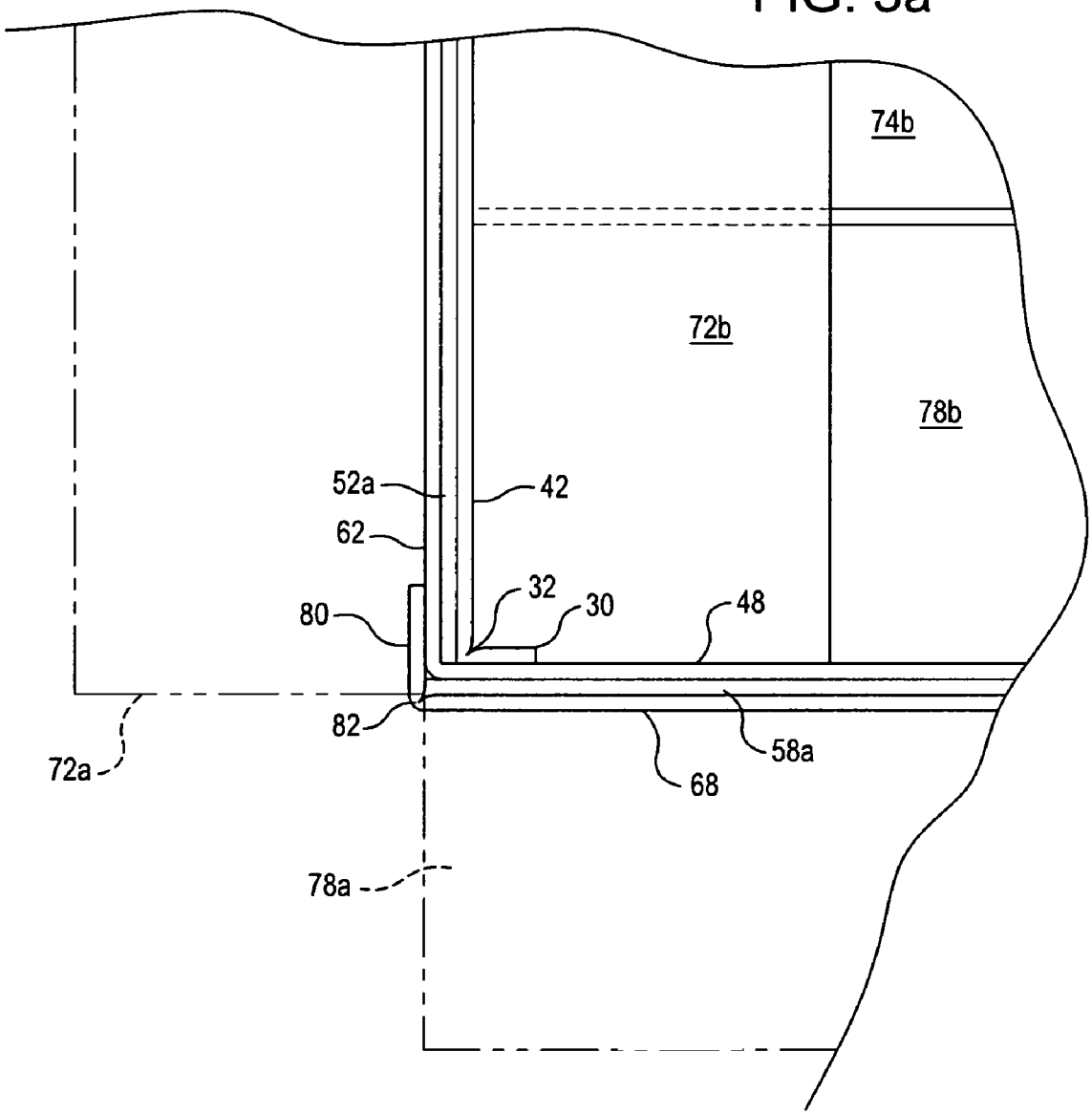
FIG. 3*a* is a detailed plan view of a corner of the embodiment shown in FIG. 3.

Also shown in FIG. 5 is an offset with respect to the slits separating adjacent flaps 70 and the point-to-point scores separating adjacent outer panel 60. Unlike the continuous scores 34*a*, 34*b*, and 34*c* of inner panel 40 (which create inner panel portions 42, 44 and 46) and middle flaps 50 (which partially define each middle flap portion pair 52*a/b*, 54*a/b*, 56*a/b* and 58*a/b*), and which result in equally dimensioned walls, flaps 70 have differing dimensions when compared to their companion panels. Because flaps 70 form end walls as opposed to sidewalls, there is no need for such symmetry. Moreover, and as best shown in FIG. 3, because flaps 70 will be positioned orthogonal to the sidewalls comprising inner panel 40, middle flaps 50 and outer panel 60, the dimensionally larger flaps will extend over the entire exposed edges of outer panels 60 when container 20 is in the assembled configuration. The consequence of this arrangement is that all exposed vertical sidewall edges can be "covered" by the end flaps, and that vertical compression loads can be evenly distributed to the end flaps. See also FIG. 11.

Figure 6:
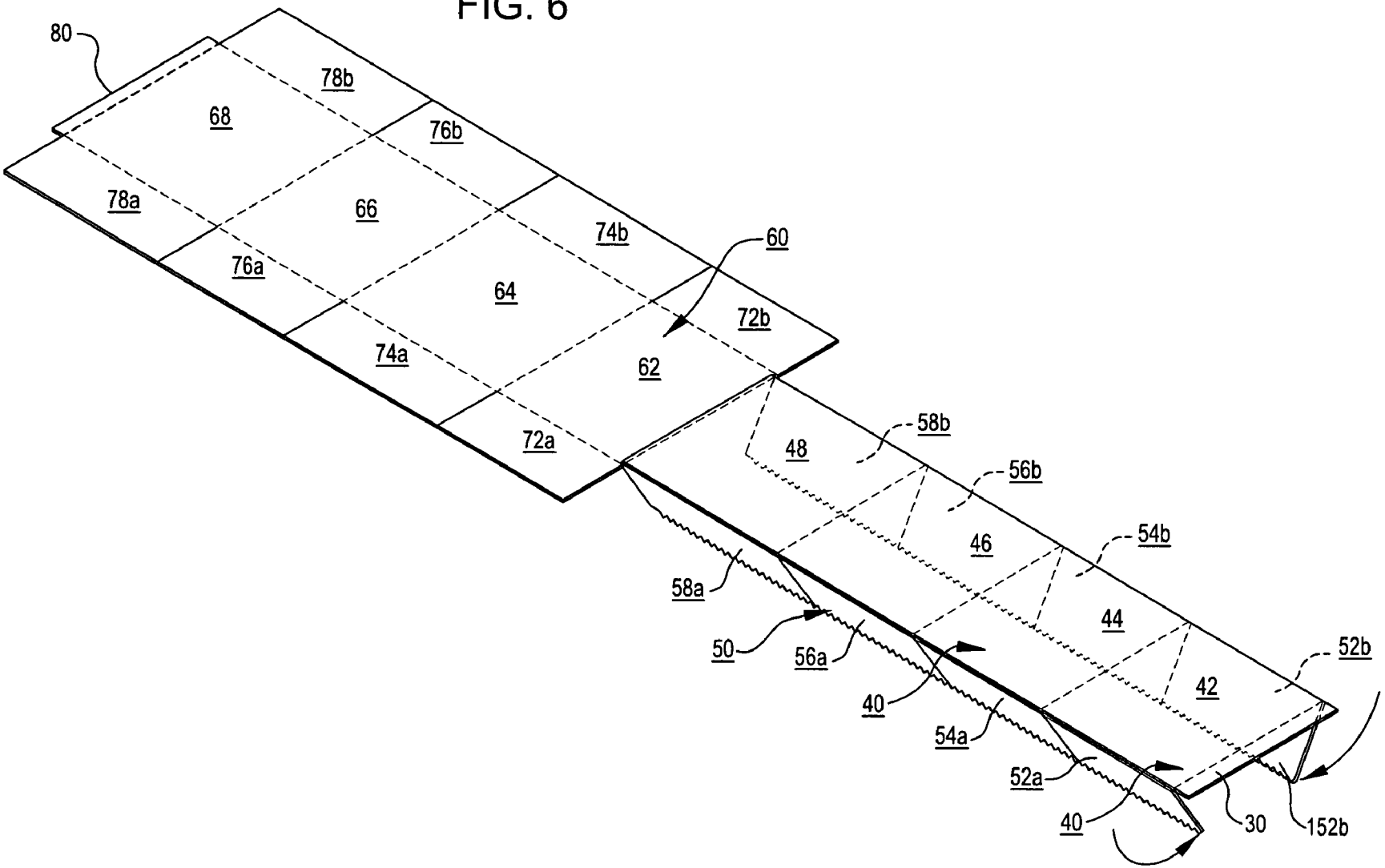
FIG. 6 is a perspective view of a first step in forming a multi-walled container using the "blank" of FIG. 4 where the middle flaps are folded into close proximity to form a middle sidewall of corrugated material.
Figure 7:
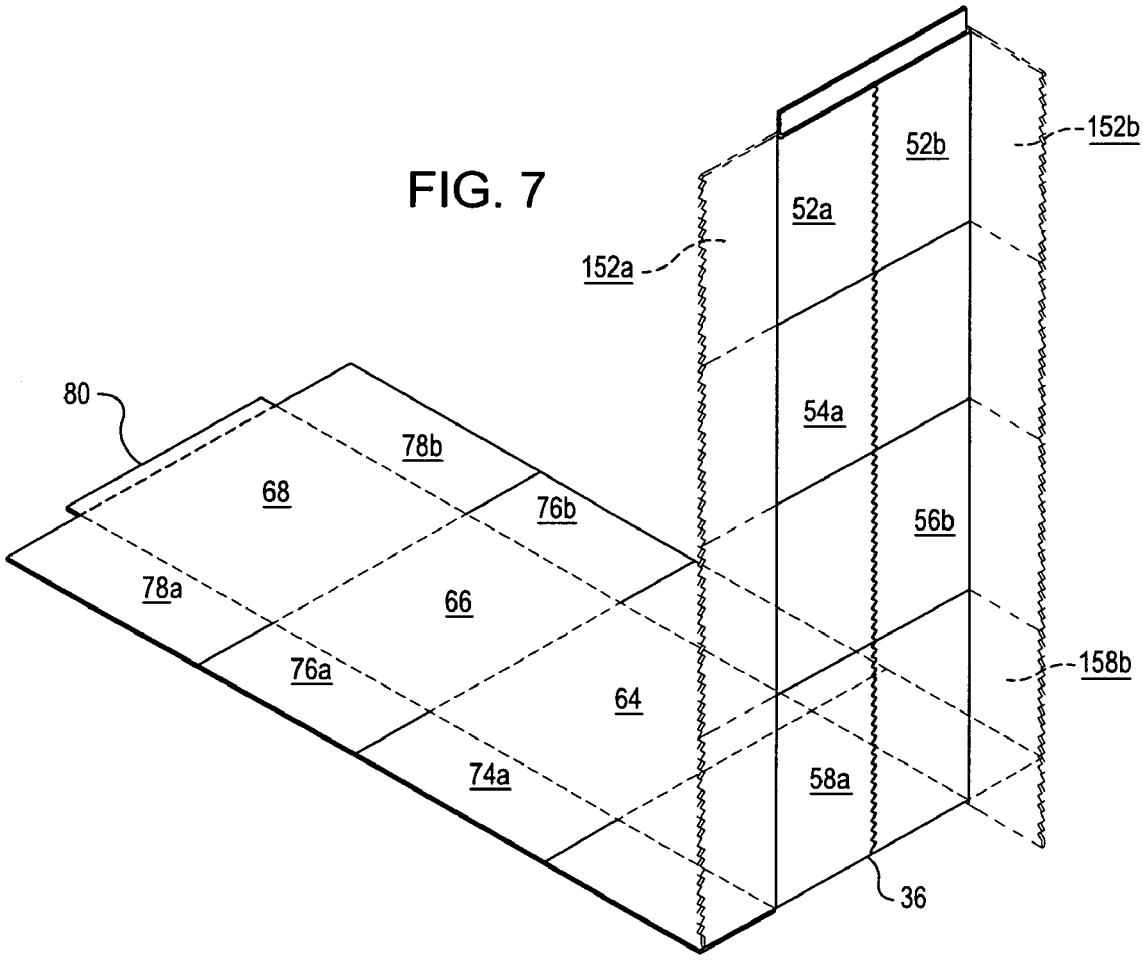
FIG. 7 is a perspective view of a second step in forming a multi-walled container using the "blank" of FIG. 4.

Turning then to FIGS. 6-12, the assemblage of container 20 is shown in detail. Completed blank 22, as described in FIG. 4, emerges from a converting machine and enters a folding and gluing section of the process. Using folding rails or paddles, co-joined middle flap portions 52*a*, 54*a*, 56*a* and 58*a*, and 52*b*, 54*b*, 56*b* and 58*b* are down folded 180°, along slit-scores 43*a*, 45*a*, 47*a* and 49*a*, and 43*b*, 45*b*, 47*b* and 49*b* to join in surface-to-surface area contact with respective inner panel portions 42, 44, 46 and 48 as shown in FIG. 6. Prior to initiation or completion of the 180° folding process, adhesive is applied to the contact area surfaces preferably using a spray coating system. On completion of the 180° folding and gluing process, chevron edges 53*a/b*, 55*a/b*, 57*a/b* and 59*a/b* meet about mid way of inner panel portions 42, 44, 46 and 48. The 'serrated' and intermeshing nature of chevron edges 53*a/b*, 55*a/b*, 57*a/b* and 59*a/b* distribute the joined line over a greater area than a pure straight cut and now appear on the underside of the flat box blank.

Figure 8:
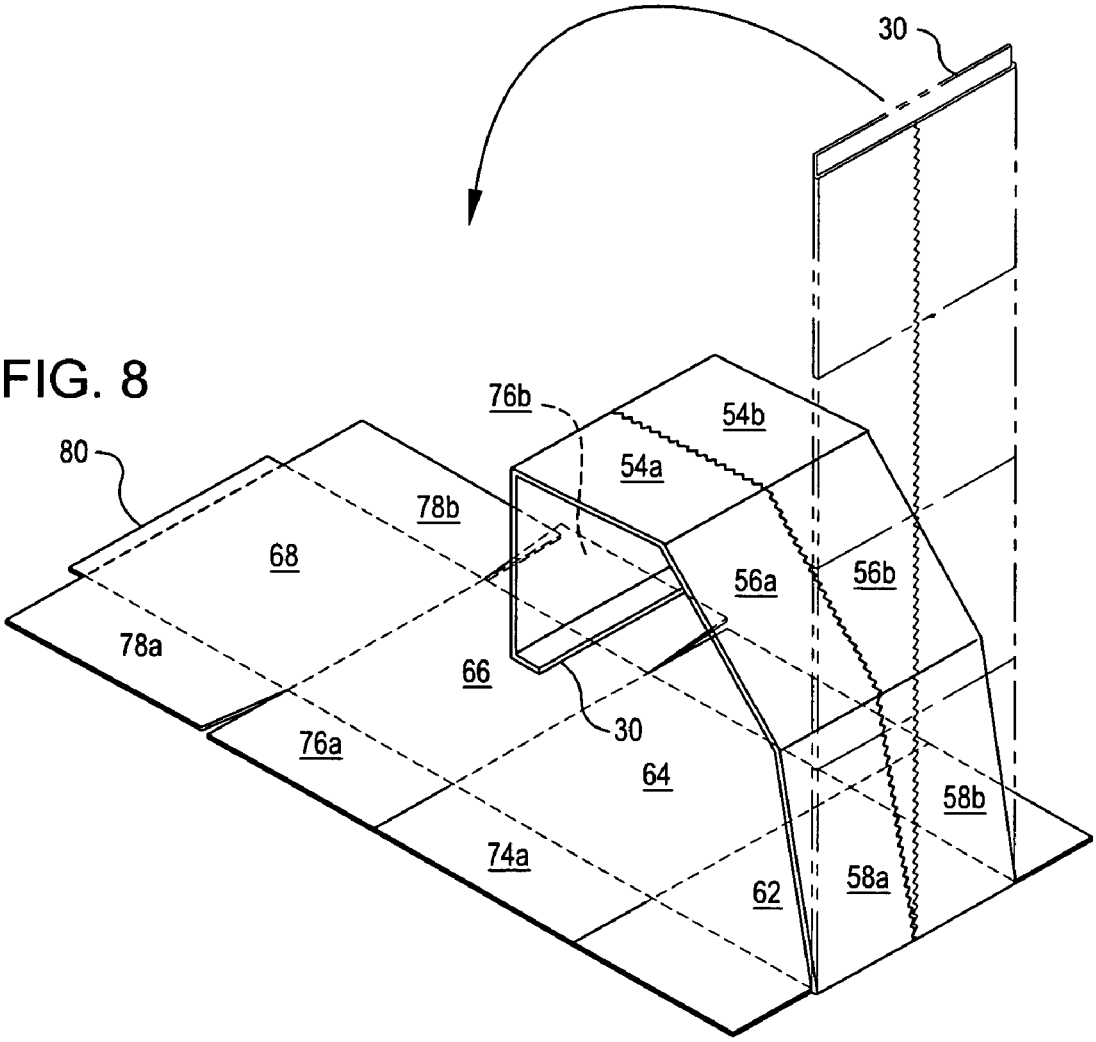
FIG. 8 is a perspective view of a third step in forming a multi-walled container using the "blank" of FIG. 4 where the combined inner panel and middle flaps are involuted.
Figure 9:
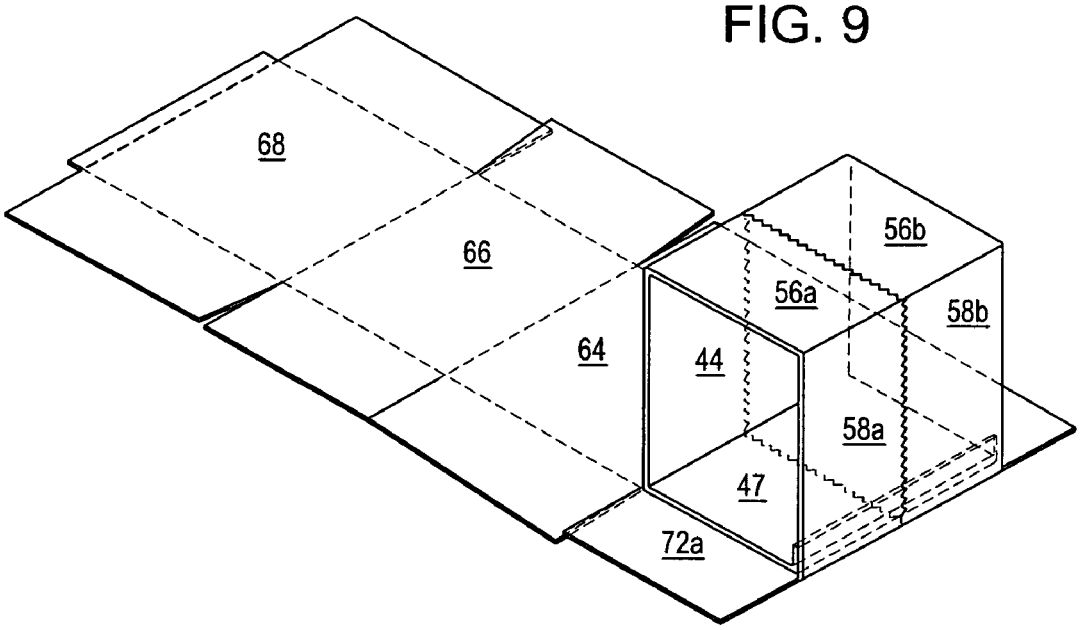
FIG. 9 is a perspective view of a fourth step in forming a multi-walled container using the "blank" of FIG. 4 where an inner glue tab is attached to an inner panel, thereby forming a basic container shape.

Using a gripper mechanism, inner tab 30 is up-folded 90° at score 32, inner panel portion 42 (with middle flap pair 52*a/b*) is up-folded 90° at score 34*a*, inner panel portion 44 (with middle flap pair 54*a/b*) is up-folded 90° at score 34*b*, inner panel portion 46 (with middle flap pair 56*a/b*) is up-folded 90° at score 34*c*, and inner panel portion 48 (with middle flap pair 58*a/b*) is up-folded 90° at score 36, as is shown in FIG. 8. All 90° folds are 'up' and therefore away from the surface joint of chevron edges 53*a/b*, 55*a/b*, 57*a/b* and 59*a/b*. The resulting structure is best shown in FIG. 9.

Figure 10:
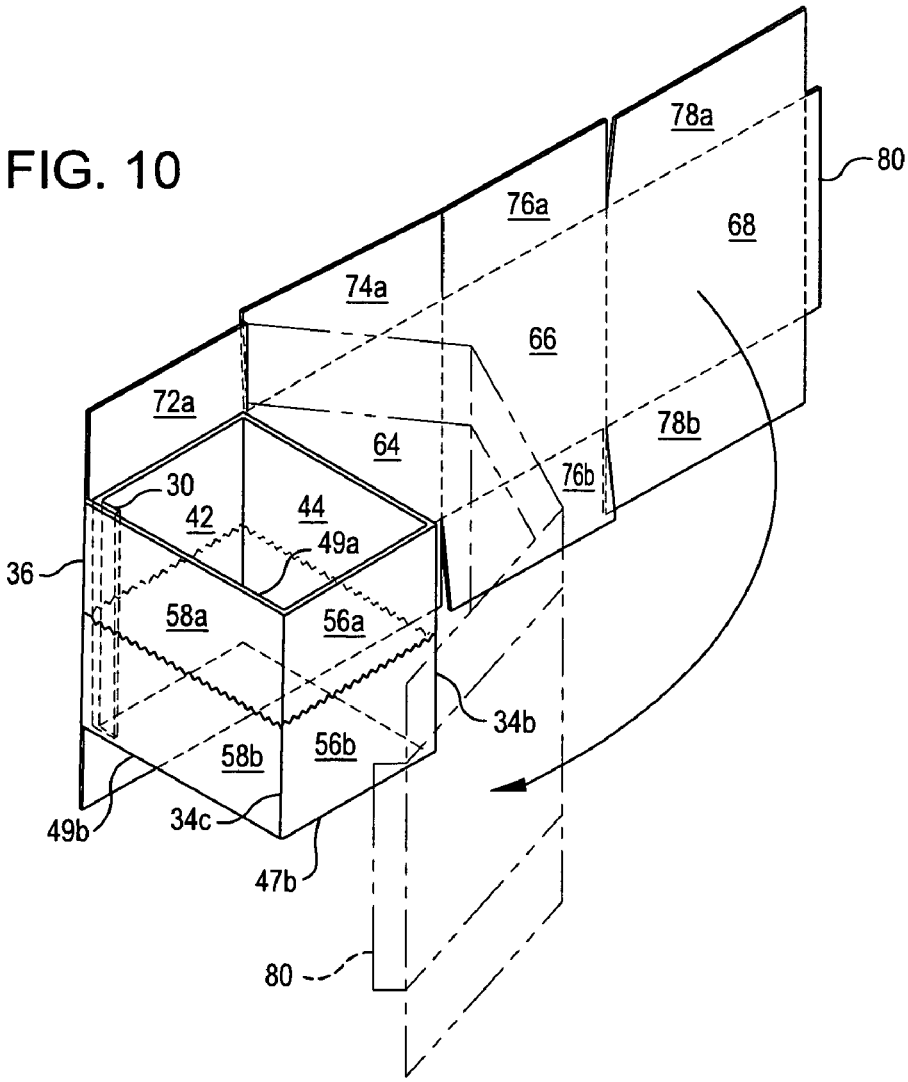
FIG. 10 is a perspective view of a fifth step in forming a multi-walled container using the "blank" of FIG. 4 where the outer panels are wrapped around the basic container of FIG. 9.

Adhesive is applied to the intended mating surfaces of outer panel portions 62, 64, 66 and 68, and the up-folding process continues with outer panel portion 62 folding 90° at score 38*a*, outer panel portion 64 folding 90° at score 38*b*, outer panel portion 66 folding 90° at score 38*c*, and outer panel portion 68 folding 90° at score 82, with outer glue tab 80 completing the folding and gluing process. This process is best shown in FIG. 10. As those persons skilled in the art will appreciate, the up-folding process may be accomplished by use of a forming mandrel or other aid.

The collective effect of the multiple-90 degree folding and gluing process takes the original flat, rigid corrugated board blank, comprising inner tab 30, inner panel 40, middle flaps 50, which form an intermediate panel, and outer panel 60, as well as optional outer tab 80, all as shown in FIG. 4, and forms a multi-walled, four sided, finished container/bin, with single wall flaps top and bottom, that has no 'manufacturers-joint', as best shown in FIG. 11. Because the relaxed state (manufacturer's resting position) is the use state of the container, there is a natural tendency of the container to return to its resting position if collapsed. In single wall construction containers, this advantage is of little consequence; however, in multi-walled containers the force necessary to form the desired container shape from a knocked-down configuration can be significant if the teaching of the invention are not followed. Therefore, there is a significant labor advantage to constructing a multi-walled container to have a resting position the same as its use position. Furthermore, by incorporating panel scores at each edge, knockdown of the container is made easier (the score lines further localize any resulting crushing, thereby preserving the structural integrity of the container at locations adjacent to the edges).

By incorporating one, some or all of the features described above, significant benefits associated with strength and material costs can be realized (manufacturing efficiencies will be addressed below). The following table exemplifies the relative advantages of one series of container embodiments according to the invention. Here, the Greenfield containers comprised all features of the above-described embodiment while the prior art containers (HP) were constructed from 2 panel layers of double wall corrugated material or 3 panel layers of double wall corrugated material where the panel layers are nested but not adhered to each other.

| Box (¼ cube half size) | Crush in (lbs.) | Weight (lbs.) |
|---|---|---|
| HP 1 - 2 panel layers | 9265 | 10.90 |
| HP 2 - 2 panel layers | 8815 | 10.90 |
| Greenfield 1 (heavy glue) | 13290 | 10.75 |
| Greenfield 2 | 12420 | 10.20 |

-continued

| Box (¼ cube half size) | Crush in (lbs.) | Weight (lbs.) |
|---|---|---|
| Greenfield 3 | 11965 | 10.20 |
| HPT 1 - 3 panel layers | 13650 | 13.95 |
| HPT 2 - 3 panel layers | 13200 | 14.00 |

As can be discerned from inspection of the above table, containers constructed according to the invention have superior crush resistance (a major factor in container evaluation) over constructions of the prior for comparable weights, or significantly less material usage for comparable crush resistance values. As will be seen below, methods for making containers according to the invention further increase cost savings by streamlining manufacturing and handling actions.

Heretofore, construction of multi-walled containers according to various embodiments of the invention has focused on general manipulation of the blank to form container precursors and containers, as exemplified in FIGS. 4, and 6-11. The following disclosure is directed to a systems approach for mass producing containers according to the invention and practicing related methods. As with the previous disclosure concerning triple sidewall containers, the below disclosure describes a process and its variants for mass manufacturing such containers. The skilled artisan will appreciate that the disclosed modes and approaches are not exclusive to the creation of containers according to the invention, but represent both general and specific implementations intended to identify presently preferred means for accomplishing those objectives.

Given the high level of automation associated with container manufacturing processes, e.g., computerized and servo driven production apparatus, many of the following actions are autonomously carried out by machines having received appropriate programming commands. The skilled practitioner will appreciate that prior to operating such programmable machines it is necessary to define the program parameters and enter them into the machine programming interface. Consequently, the following disclosure is intended to establish a sample series of events that result in the production of a desired container based upon instructions previously entered into the various machines.

Basic material used for constructing container 20 is derived from a corrugator (not shown) that produces a continuous web of double face, single wall corrugated material. The web may be immediately consumed, or may be stored as cut blanks until needed. In the illustrated example, blanks 22 having a total length of about 30 feet (9 meters) are fashioned from the web by cutting, for example. Once appropriately cut blanks 22 are obtained, the blanks are subject to various slotting, slitting, scoring, and cutting processes as is necessary to form a desired container 20 as previously described.

In a preferred system, various slotting, slitting, scoring, and cutting processes are carried out by a pair of opposing machines, which are supplied with blanks using conventional conveyor means. These machines, preferably RAPIDBOX units from Rapidex (a division of the Bobst Group of Switzerland) of Angers, France, create the desired blanks through appropriate programming, which is determined based upon the size and geometry of the intended container. The RAPIDBOX machine can accommodate blanks up to 110"×400" or 2.8 m×10 m, which makes it particularly suited for large format container manufacturing such as described herein. In other scenarios, these processes may be carried out by more dedicated machinery, such as a plurality of various slotting, scoring, slitting and rotary die cutting machines, serially established in the production line. Regardless of how the blanks are processed, the resulting blanks are delivered to folding and gluing stations as will now be described.

Figure 13:
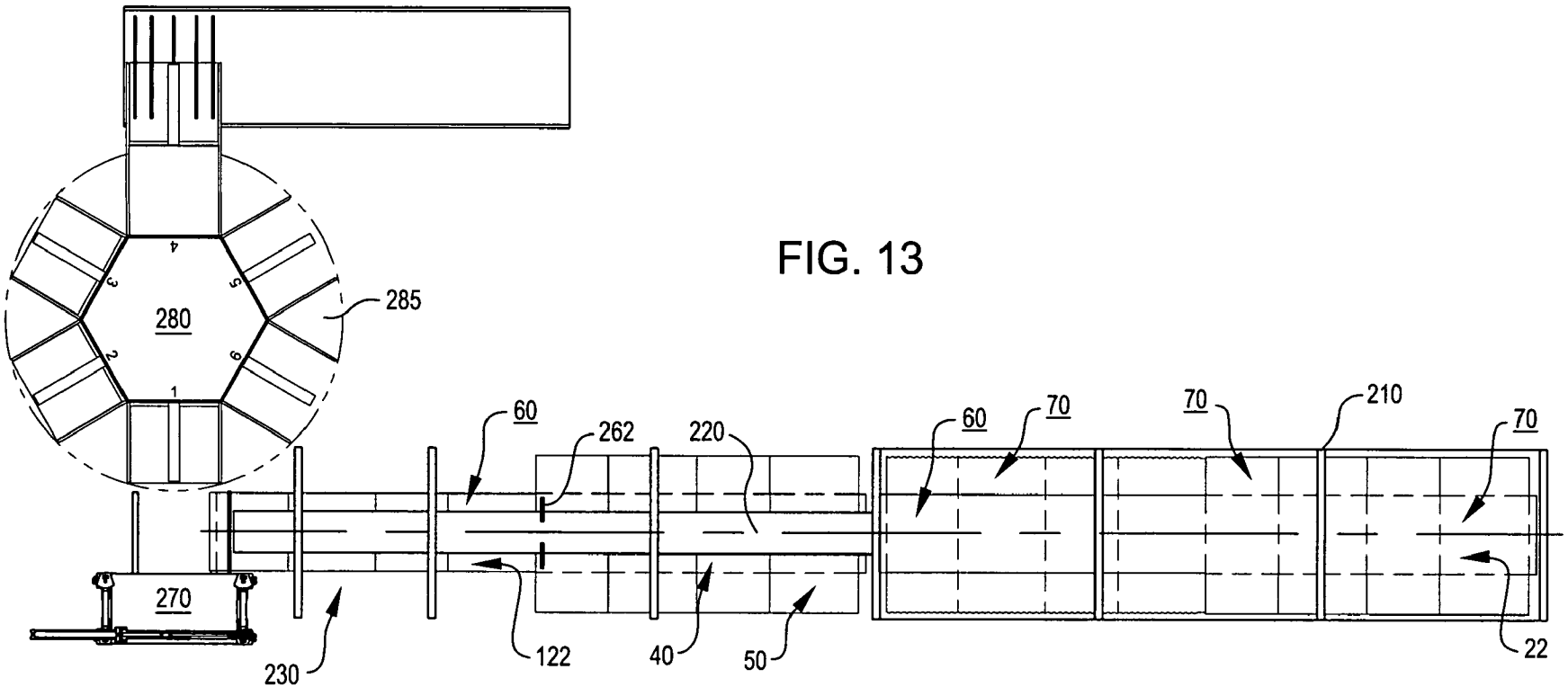

Upon exiting from the converting machines, blanks 22 are deposited on receiving platform 210 as best shown in FIG. 13 where after they are conveyed to vacuum assisted overhead conveyors 220 to folding and gluing station 230. This mode of conveyance is desirable over more conventional forms for two reasons. First, it retains full exposure of the underside surface of inner panel 40 (designated inner panel surface 140) and middle flaps 50 (designated middle flaps surface 150), which becomes important during the "up winding" process described below. Second, it accurately retains the specific position of blanks 22 relative to the other apparatus, which is important when precision application of adhesive is necessary. However, the skilled practitioner will appreciate that inverting blank 22 such that inner panel surface 140 and middle flaps surface 150 are exposed on an upper side and blank 22 is supported by a conventional conveyor will permit proper conveyance and use of middle flap 50 up folding as well as "down winding" (see below).

Depending upon design considerations, which include cost and performance criteria, adhesive deposited on any blank 22 from adhesive application means may be selectively deposited or may be applied to the entirety of inner panel surface 140 and/or middle flaps surface 150 exposed to a first adhesive means. Selective deposition of adhesive involves the intelligent location of adhesive lines or zones within the bounds of these panels and/or flaps. While in the illustrated embodiment the adhesive is applied via spray nozzles 262 and 264 ejecting a PVA or hot melt adhesive, any adhesive application means capable of depositing an intended amount and type of adhesive on any blank 22 is sufficient. The illustrated application means and adhesive composition has been chosen in an effort to optimize the production speed of the illustrated process. At roughly 200 feet per minute, the applied adhesive has sufficient time to "set" prior to folding and mating of middle flaps 50 as will now be described.

Figure 14:
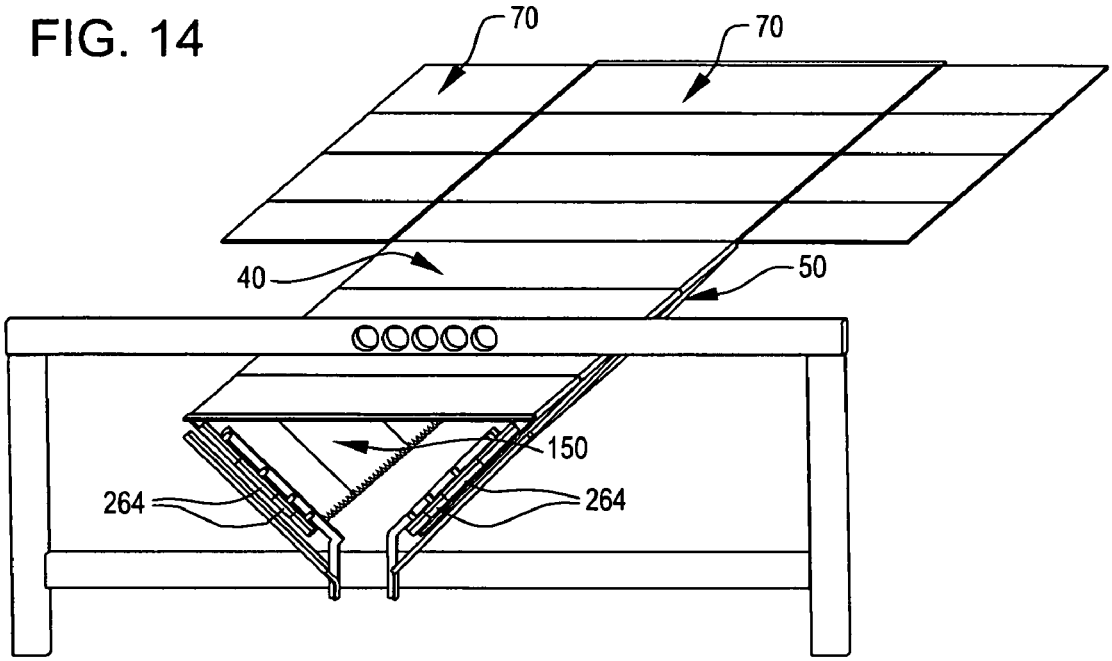
FIG. 14 is an isometric view of a folding and gluing station, which is part of the system shown in FIG. 13.

Once adhesive has been applied to inner panel surface 140 and/or middle flaps surface 150, actuated folding arms cause middle flaps 50 to involute, and middle flaps surface 150 to contact inner panel surface 140 as best shown in FIG. 14. A pinch roller combination may be used to compress middle flaps 50 and inner panel 40 together in conjunction with overhead conveyor 160, otherwise the wrapping process described below will generate compressive contact between these two surfaces.

At this point, converted blank 22 has been transformed into precursor 122. To prepare precursor 122 for container 20 construction, adhesive must also be applied to the exposed surface of outer panel 60 (and/or the exposed surface of middle flaps 50, which are now on the "underside" of precursor 122). In the illustrated embodiments, second adhesive application means 262 is provided, and selectively applies adhesive to the exposed surface of outer panel 60.

Figure 16:
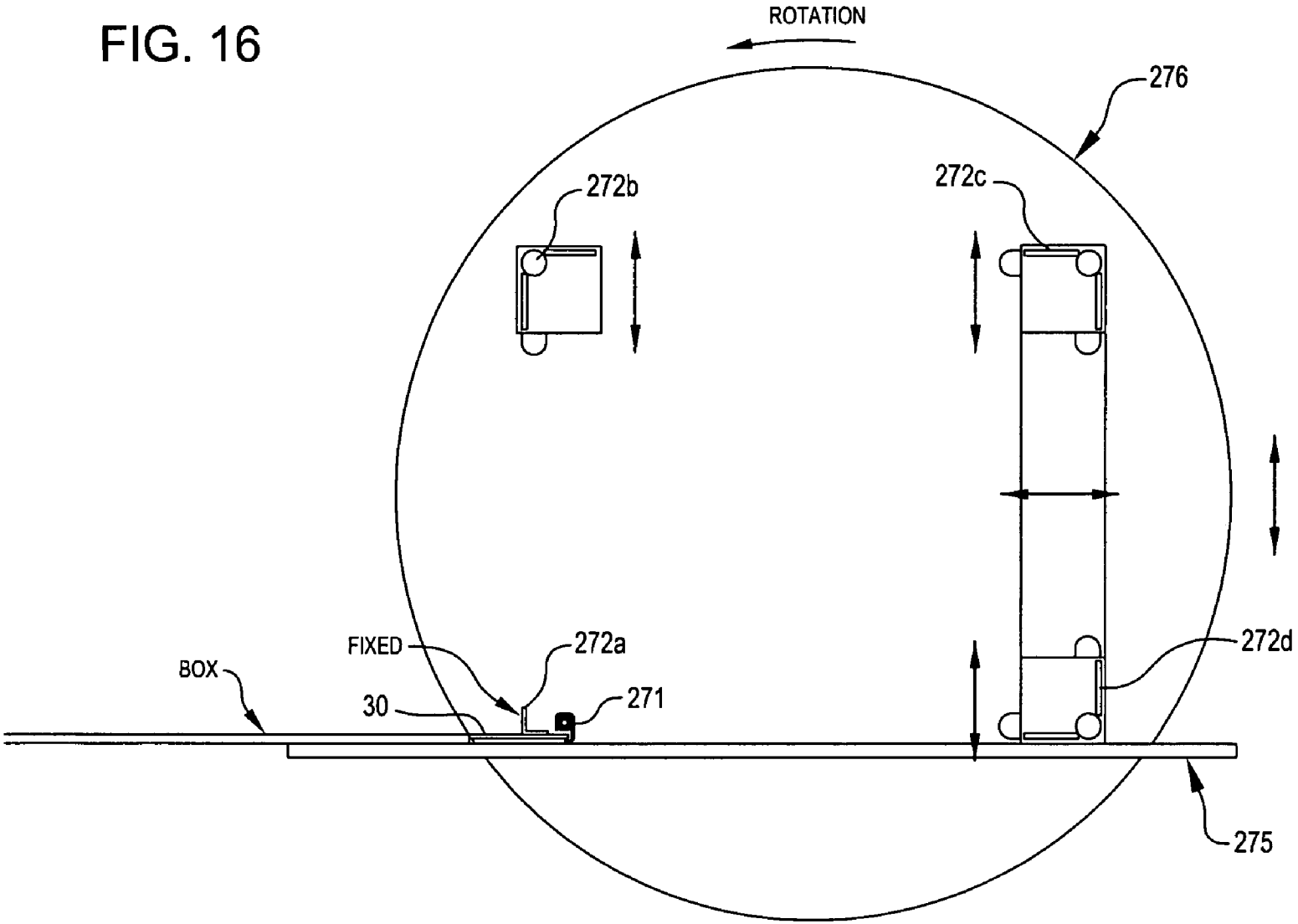
FIG. 16 is a schematic elevation view of the rotator portion of the up-winder shown in FIG. 15 wherein the relative movement of the four mandrel bars are shown.

Turning then to FIG. 16, as tab 30 approaches winder 270, clamp element 271 is opened (if not already open) to receive tab 30. Depending upon the mode of implementation, rotator 276 may already be rotating or may begin rotation after clamp element 271 engagement with tab 30. While a mechanical engagement means is shown, alternative means such as vacuum engagement are contemplated and will be appreciated by the skilled practitioner. In addition to clamp element 271 or its equivalent, rotator 276 preferably includes a plurality of folding bars equal in number to the number of container vertical corners, which in this case is four (4). Folding bars in general localize bending stresses during container formation and provide a convenient, low cost and low mass solution to container formation. While schematically shown herein, folding bars 272*a-d* may be hydraulically or mechanically movable on rotator 276, with the only requirement being that the assembly can accept precursor 122, assist in forming container 20 and release container 20 such that another precursor 122 can be engaged therewith.

Figure 1:
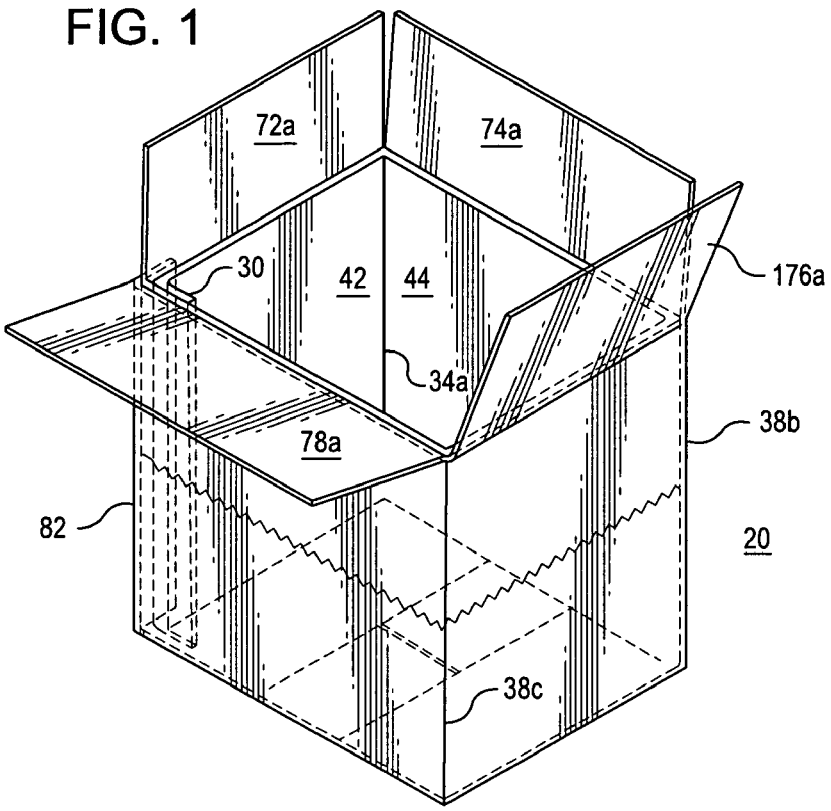
FIG. 1 is a perspective view of a first embodiment of the invention shown in a generally assembled state.
Figure 2:
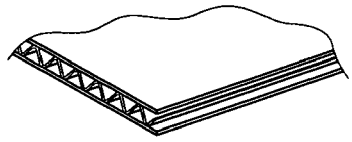
FIG. 2 is a detailed perspective view of a portion of the double liner corrugated material used in the construction of the first embodiment.

As precursor 122 is wound about rotator 276, sufficient tension should be applied to ensure that outer panel 60 securely bonds with middle flaps 50 (or any other intended portion of precursor 122, as the case may be) and that outer tab 80 (if present) will properly fit around a vertical corner at 82 (see FIG. 1). Proper tension can be imparted by reducing the ejection speed of precursor 122 before rotator 276 while maintaining constant rotation speed; increasing rotation speed while maintaining constant ejection speed; and/or increasing the relative effective displacement of folding bars 172*a-d*. However, a preferred means for maintaining proper parameters is to vertically adjust rotator 276 such that precursors 122 are always engage rotator 276 in a planar fashion. As noted in FIGS. 15 and 16, winder 270 is constructed to move in the vertical direction (see hydraulic ram 277 linked to pulley system 278 in FIG. 15). Alternatively, an external compression element can be applied during winding of the precursor on the mandrel, with the result being compression between the container sidewall layers. The foregoing methods for ensuring proper winding of the precursor are not exclusive, and those persons skilled in the art will appreciate other means for accomplishing the same or similar results.

In order to ensure that corrugated material wound on winder 270 does not inadvertently "unwind", outer panels 62-68 must be retained proximate to intermediate panels 52-58 during the adhesive setting process, which normally would not occur when container 20 is on rotator 276. In a presently preferred embodiment, winder 270 includes bottom support table 275, which has an upper surface approximately at the level of blank 22. By maintaining the last wound panel/tab in compressive contact with support table 275, container 20 will not prematurely "leave" winder 270. In this position, there is sufficient tension precursor 122 that bonding can occur between the surfaces of panels 140 and 150 as well as the surfaces of panels 50 and 60. However, the set time of such adhesive is usually longer than the time it takes to wind precursor 122. Therefore, a "curing" station is needed. In the presently disclosed embodiment, a carrousel arrangement is used, as is best shown in FIG. 13 wherein further transportation of formed container 20 is sufficiently delayed to permit sufficient time for the adhesive to cure, thereby ensuring that container 20 will not "unwind".

To remove formed container 20 from winder 270, one, some or all of the folding bars 172*a-d* may be retracted in such a manner so as to reduce the friction between them and container 20, although such action is not necessary for the removal of container 20. In certain embodiments, an exterior engaging sliding element or other means for removing container 20 from mandrel 170 may then be employed. Preferably, however, an arm having a plurality of extensible elements (mechanical and/or pneumatic and/or electric and/or hydraulic) is inserted into container 20, the elements extended to compressively contact the inner walls of container 20 (or engage therewith via vacuum assist), and then the arm removed to "pull" container 20 from folding bars 172*a-d*. Support table 285 is used for similar reasons as that for support table 275.

As assembly 280 rotates, additional formed containers 20 are removed from winder 270. Once a formed container reaches a predetermined location (shown in FIG. 13 as being opposed to winder 270, the engagement process is reversed, and the formed container removed from the extending arm. Once removed, the displaced container may then be "knocked-down" for storage and/or transportation.

Figure 15:
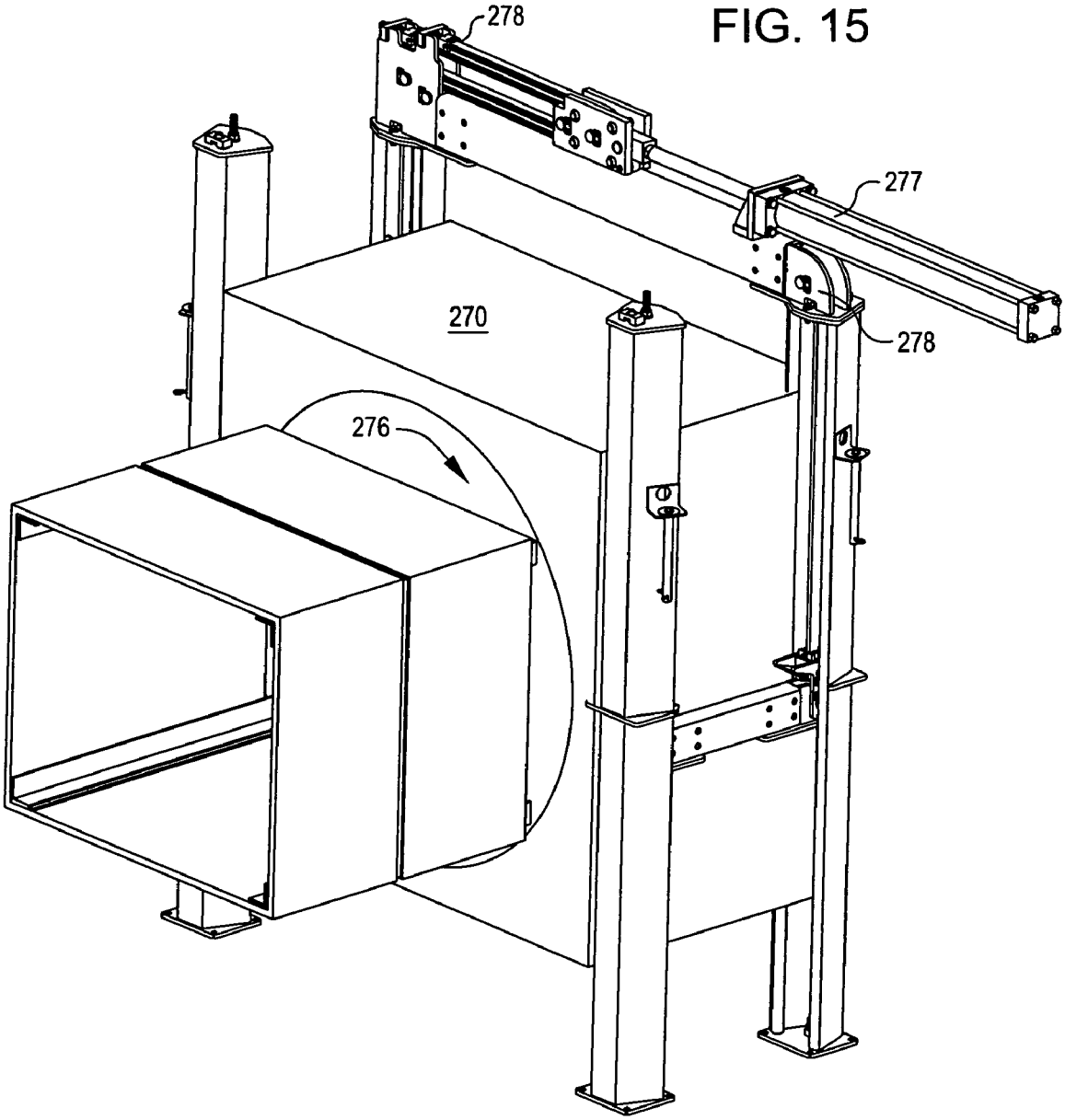
FIG. 15 is a perspective view of an up-winder, which is part of the system shown in FIG. 13.

Because of the relative difference in thickness between the side panels and the flaps, certain method embodiments of the invention provide for the back folding of outside flaps 70 onto the side panels such as shown in FIG. 15. If such a final configuration is desired, these embodiments of the invention fold the end flaps onto the side panels at the same time that the intermediate flaps are folded. Thus, when precursor 122 is subjected to up winding, outside flaps 70 are not in the extended position, but are placed in compressive contact with the panels 60. In addition to removing the labor step of separately folding these end panels once container 20 has been formed, shorter mandrels and container removing apparatus can be used as the overall height of the container is shorted by the depth of the end flaps. Additionally, in such embodiments, it may be considered desirable to eliminate tab 80 so that the contacting surface is sufficiently planar to avoid binding and/or crushing.

In processes such as in the preceding paragraph, it is desirable to retain a small section of material linking flaps 72-78 to prevent premature unfolding (this may occur through incomplete slitting between the panels at the distal end of the flaps). Thus, when the knocked down containers are delivered to the customer, flaps 72-78 are separated and folded into place.

What is claimed:

1. A method for creating a multi-wall container precursor from a single blank of material that defines a longitudinal direction from a first end to a second end, the method comprising:

defining an inner panel that forms inner sidewalls of the container when assembled, the inner panel comprising a plurality of inner panel portions, each inner panel portion being contiguous with any adjacent inner panel portion and each inner panel portion comprising one inner sidewall of the container when assembled;

defining at least one pair of opposing middle flaps that extends from the inner panel to a distal edge, wherein the sum of the lateral length of the pair of middle flaps from their intersection with the inner panel to the distal edge is equal to or less than the lateral length of the inner panel from the intersection of a first opposing middle flap to the intersection of a second opposing middle flap, and wherein each middle flap comprises a plurality of flap portions, each flap portion being contiguous with any adjacent flap portion and each opposing pair of flap portions comprising one middle sidewall of the container when assembled;

defining an outer panel that extends from the inner panel and forms outer sidewalls of the container when assembled, the outer panel comprising a plurality of outer panel portions, each outer panel portion being contiguous with any adjacent outer panel portion and each outer panel portion comprising an outer sidewall of the container when assembled; and involuting at least one pair of opposing middle flaps to bring their respective distal edges into proximity with each other and attaching them to the inner panel, thereby forming intermediate sidewalls when the blank is assembled into the container.

2. The method of claim 1 further comprising establishing a glue tab at the first end of the blank and a glue tab at the second end of the blank wherein the first glue tab is adhered to the inner panel when the container is assembled and the second glue tab is adhered to the outer panel when the container is assembled.

3. The method of claim 1 further comprising forming non-linear distal edges of the middle flaps.

4. The method of claim 3 wherein the distal edges of the middle flaps are one of a repeating rectilinear, curvilinear, or a combination rectilinear and curvilinear design.

5. The method of claim 1 wherein the distal edges of the middle flaps are complementary such that upon involution, the distal edge of one middle flap will substantially abut the distal edge of the opposing middle flap.

6. The method of claim 1 further comprising establishing a score between middle flap portions.

7. The method of claim 1 further comprising establishing a score between inner panel portions.

8. The method of claim 1 wherein the material comprises a double liner corrugated material.

9. The method of claim 1 comprising forming the lateral dimension of any inner panel portion to be less than the lateral dimension of any outer panel portion.

10. The method of claim 1 further comprising forming at least one pair of opposing end flaps to extend from at least some outer panel portions wherein each end flap is separated from any adjacent end flap by one of a slot, a slit or a gap.

11. The method of claim 10 wherein pairs of opposing end flaps extend laterally from each outer panel portion.

12. The method of claim 11 further comprising establishing a stress relief feature at an interface between each end flap and each outer panel portion.

13. The method of claim 10 further comprising establishing a stress relief feature at an interface between an end flap and an outer panel portion.

14. The method of claim 13 wherein the stress relief feature comprises a hole defined at least in part by two adjacent end flaps and the outer panel.

15. The method of claim 10 wherein the longitudinal length of each end flap is one of greater or less than the longitudinal length of a corresponding outer panel portion from which it extends.

16. The method of claim 1 wherein the resting position of a container formed from the blank is the same as the use position of a container formed from the blank.

17. The method of claim 1 wherein the blank is derived from a web of double liner corrugated material.

18. The method of claim 1 wherein the blank is derived from a continuous process beginning with a corrugator.

19. The method of claim 1 wherein one inner panel portion has a longitudinal length longer than any other inner panel portion.

* * * * *